United States Patent [19]

Kluck

[11] 4,169,502

[45] Oct. 2, 1979

[54] TUBULAR HEAT EXCHANGER

[75] Inventor: Erwin Kluck, Bad Nennhorf, Fed. Rep. of Germany

[73] Assignee: Volkswagenwerk Aktiengesellschaft, Wolfsburg, Fed. Rep. of Germany

[21] Appl. No.: 781,553

[22] Filed: Mar. 28, 1977

[30] Foreign Application Priority Data

Mar. 31, 1976 [DE] Fed. Rep. of Germany ..... 2613747

[51] Int. Cl.[2] ..... F28D 1.04

[52] U.S. Cl. ..... 165/151; 165/DIG. 13; 165/172; 165/182

[58] Field of Search ..... 165/DIG. 13, 151, 181, 165/182, 172

[56] References Cited

U.S. PATENT DOCUMENTS

| | | | |
|---|---|---|---|
| 2,228,549 | 1/1941 | Young | 165/151 X |
| 3,080,916 | 3/1963 | Collins | 165/151 |
| 3,902,551 | 9/1975 | Lim et al. | 165/151 X |
| 3,916,989 | 11/1975 | Harada et al. | 165/151 |

FOREIGN PATENT DOCUMENTS

| | | | |
|---|---|---|---|
| 585172 | 2/1925 | France | 165/151 |
| 231565 | 4/1969 | U.S.S.R. | 165/172 |

*Primary Examiner*—Ira S. Lazarus
*Attorney, Agent, or Firm*—Brumbaugh, Graves, Donohue & Raymond

[57] ABSTRACT

A tubular heat exchanger, which may be used as an automobile radiator or the like, comprises tubes for transporting a liquid heat transfer medium between two collecting chambers, and lamellar baffles, supported by the tubes in substantially perpendicular relationship thereto, for intercepting a gaseous heat transfer medium flowing past the tubes. The tubes are disposed substantially equidistant one from another such that, when viewed in cross section, their centers are arranged in series along a first line which extends uniformly back and forth with respect to a substantially straight second line. Each section of the first line, which extends from one side to the other of the second line, passes through at least three tubes.

6 Claims, 2 Drawing Figures

TUBULAR HEAT EXCHANGER

BACKGROUND OF THE INVENTION

The present invention concerns a tubular heat exchanger comprising tubes for transporting a liquid heat transfer medium between two collecting chambers, and lamellar baffles, maintained on the tubes essentially perpendicular thereto and in close proximity to one another, for intercepting a gaseous heat transfer medium flowing past the tubes .

Tubular heat exchangers of the above-described type have conventionally been used, for example, as automobile radiators. Such heat exchangers, which may be produced of light metal, comprise a plurality of tubes transporting the cooling water between two radiator tanks, the tubes being arranged transversely to the direction of flow of the cooling air. In order to increase the air-side heat transfer, fins in form of thin-walled lamellar air baffles are mounted on the tubes to intercept the cooling air. These baffles are superimposed in close proximity one above the other to form a "stack" of fins along the tubes.

Following the conventional designs of such heat exchangers, the tubes are arranged in two or more rows, one behind the other, and the baffles are correspondingly constructed in form of an elongated rectangle with passages for the tubes arranged in rows. The stacked baffles are maintained in spaced relation by the collars produced at the passages, and also by bent-up projections produced by so-called "tear holes".

In a heat exchanger designed in this manner, the cooling air action in the first tube row is quite favorable with regard to both the flow conditions and the temperature level. However, in the subsequent rows of tubes which follow, these conditions become increasingly unfavorable. This is due to the fact that the subsequent rows of tubes are placed, at least in part, leeward of the first row of tubes so that the cooling air does not impinge directly on the face of each tube. Moreover, due to the increasing temperature of the air as it flows through the heat exchanger, the temperature difference relative to the cooling water decreases so that, seen as a whole, the heat transfer is less favorable in the rear rows of tubes. Finally, the stack of baffles is comparatively deep, due to the necessary distance between the rows of tubes, so that considerable material is required for the baffles themselves.

It is therefore an object of the invention to provide a tubular heat exchanger of the aforementioned type which, for a given number of tubes, facilitates an improved air flow and thereby a more uniform heat transfer among the individual tubes and permits a reduction of the structural depth in the air flow direction.

SUMMARY OF THE INVENTION

In accordance with the invention, there is provided a tubular heat exchanger, which may be used as an automobile radiator or the like, comprising tubes for transporting a liquid heat transfer medium between two collecting chambers, and lamellar baffles, supported by the tubes in substantially perpendicular relationship thereto, for intercepting a gaseous heat transfer medium flowing past the tubes. The tubes are disposed substantially equidistant one from another such that, when viewed in cross section, their centers are arranged in series along a first line which extends uniformly back and forth with respect to a substantially straight second line. Each section of the first line, which extends from one side to the other of the second line, passes through at least three tubes.

Due to the fact that the tubes are arranged on such a line, which may, for example, be a zig-zag line or an undulating or sinusoidal line, all the tubes of the heat exchanger are directly acted on by the cooling air current. Thus, the tubes are all placed, as it were, in a first tube row (which, however, runs in zig-zag or wave form) without thereby reducing the number of the tubes.

If, in accordance with a further characteristic of the invention, the baffles are provided with longitudinal edges each extending parallel to the first line joining the centers of the tubes, a considerable reduction in the amount of material required for the baffles is achieved because the unused surfaces between the outermost tubes, seen in the direction of the air flow, are eliminated. Such a form of the longitudinal edges of the baffles also makes it possible to stamp the baffles from a web of material without any waste so that the material used in the production of a stack of baffles for a heat exchanger in accordance with the invention is considerably reduced. In addition, the width, in the direction of air flow, of any side plates which frame the stack may be reduced to the width of the baffles, resulting in further savings in material.

For a better understanding of the invention, together with other and further objects, reference is made to the following description, taken in conjunction with the accompanying drawings, and its scope will be pointed out in the appended claims.

DESCRIPTION OF THE PREFERRED EMBODIMENT

Figure 1:
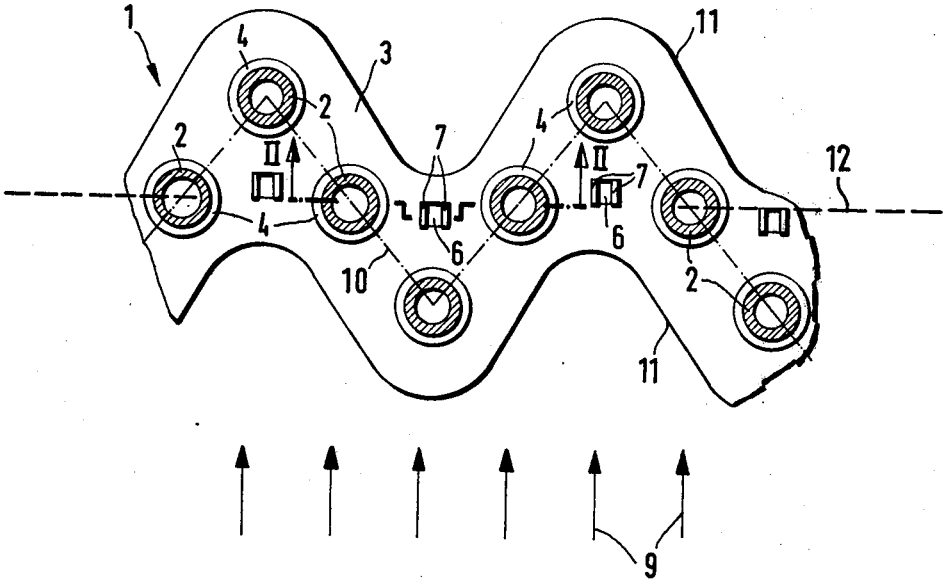
FIG. 1 is a cross-sectional view through a portion of a tubular heat exchanger according to the invention showing the stack of baffles in plan view.

As shown in the drawing, the tubular heat exchanger according to the invention has a tube and air baffle package or stack 1 which is composed of a plurality of tubes 2, preferably consisting of some light material such as aluminum, as well as vertically stacked air baffles 3. The air baffles 3 are preferably also made of thin aluminum plate and, for reasons of rigidity among others, they may be corrugated (although this is not shown in the drawing). The baffles 3 have passages 5 provided with collars 4 into which the tubes are introduced and fixed by expansion of their diameter. The collars 4 of the passages 5 serve as contact surfaces for heat transfer between the tubes 2 and the air baffles 3 and also as spacers for fixing the distance between the individual air baffles 3 stacked one above the other. There may be provided, in addition, upward projections 7 formed from "tear holes" 6 which likewise serve as spacers between the individual baffles 3. FIG. 1 shows in detail that the centers individual tubes 2 of the heat exchanger in accordance with the invention are arranged in series along a zig-zag line 10 which extends back and forth with respect to a straight line 12. In the embodiment shown, the tubes are placed at the corners and at the center of each back or forth section of the line 10. The longitudinal edges 11 of the air baffles 3 extend substantially parallel to the line 10 and are rounded off in their corner zones with a constant radius. Due to the fact that the two longitudinal edges of the air baffles correspond to each other, such baffles can be cut without waste from a plate metal web.

Figure 2:
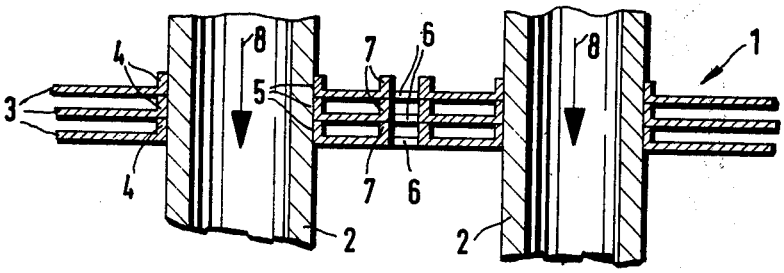
FIG. 2 is a cross-sectional view through the heat exchanger of FIG. 1, taken along the lines II—II.

The tear holes 6 are in each case placed in the zone of the inner corners or roundings of the longitudinal edges at an approximately equal distance from the three adjacent tubes. The direction of the approaching cooling air flow is shown in FIG. 1 by arrows 9, whereas in FIG. 2 the direction of flow of the cooling water through the tubes 2 is shown by arrows 8.

The essential advantage of the design of the tubular heat exchanger in accordance with the invention may be found in the fact that, due to the arrangement of the liquid-carrying tubes in a zig-zag (or possibly also in an undulating or sinusoidal) line, each individual tube of the tube aggregate is situated immediately and directly in the path of cooling air. Stated another way, none of the tubes is placed leeward of any other tube. Accordingly, the heat transfer obtained is approximately the same as for a single-row cooler. The undulating shape of the air baffles, moreover, results in substantial savings in material relative to the otherwise customary rectangular shape. Inasmuch as the air flow-through depth of the cooler block is decreased in comparison with the customary two-row design, the pressure drop in the air across the cooler is reduced. However, the pressure drop in the water remains the same if the number of water tubes is the same.

Due to the decrease in width of the air baffles, the side baffles or plates, which are provided in various heat exchangers, may be made narrower also, resulting in further savings in material. The tear holes between the tubes are arranged at points which do not substantially contribute to the heat transfer since they are placed outside ring-shaped surfaces surrounding the tubes projected onto the baffles. In accordance with the invention these ring-shaped surfaces are arranged substantially more favorably.

While there has been described what is believed to be the preferred embodiment of the invention, those skilled in the art will recognize that various changes and modifications may be made thereto without departing from the spirit of the invention, and it is intended to claim all such embodiments as fall within the true scope of the invention.

I claim:

1. In a tubular heat exchanger comprising a plurality of tubes adapted to transport a liquid heat transfer medium between two collecting chambers, and a plurality of lamellar baffles arranged closely adjacent one to the other and supported by said tubes in substantially perpendicular relationship thereto, said baffles being adapted to intercept a gaseous heat transfer medium flowing past said tubes;

the improvement wherein all of said tubes are disposed such that, when viewed in cross section, their centers are arranged in series along a single first line which extends uniformly back and forth at least twice with respect to a substantially straight second line, each section of said first line, which extends from one side to the other of said second line, passing through at least three tubes; and wherein each of said baffles has longitudinal edges which include portions extending substantially parallel to said first line.

2. The tubular heat exchanger defined in claim 1, wherein said first line is a zig-zag line having a plurality of straight sections.

3. The tubular heat exchanger defined in claim 1, wherein said longitudinal edges have rounded corners.

4. The tubular heat exchanger defined in claim 3, wherein the radius of curvature of said corners is constant.

5. The tubular heat exchanger defined in claim 1, wherein tear holes are provided in said baffles in an area adjacent the inner corners of said longitudinal edges.

6. The tubular heat exchanger defined in claim 1, wherein the tubes arranged along each section of said first line, which extends from one side to the other of said second line, are substantially equidistant one from another.

* * * * *